United States Patent [19]

Drutchas et al.

[11] 4,422,834

[45] Dec. 27, 1983

[54] POWER STEERING PUMP

[75] Inventors: Gilbert H. Drutchas, Birmingham; David J. Suttkus, Utica, both of Mich.

[73] Assignee: TRW Inc., Cleveland, Ohio

[21] Appl. No.: 261,643

[22] Filed: May 7, 1981

[51] Int. Cl.[3] ..... F04B 49/08

[52] U.S. Cl. ..... 417/283; 417/310

[58] Field of Search ..... 417/283, 282, 310

[56] References Cited

U.S. PATENT DOCUMENTS

| | | | |
|---|---|---|---|
| 3,207,077 | 9/1965 | Zeigler et al. | 417/310 X |
| 3,671,143 | 6/1972 | Clark | 417/283 X |
| 3,679,329 | 7/1972 | Drutchas et al. | 417/310 X |
| 3,728,046 | 4/1972 | Clark et al. | 417/79 |
| 3,822,965 | 7/1974 | Drutchas et al. | 417/53 |
| 3,930,759 | 1/1976 | Drutchas | 417/283 |
| 4,014,630 | 3/1977 | Drutchas | 417/283 |

*Primary Examiner*—Richard E. Gluck
*Attorney, Agent, or Firm*—Yount & Tarolli

[57] ABSTRACT

A pump includes a rotor, a cam encircling said rotor and means for effecting relative rotation of the cam and rotor about an axis. A plurality of vanes are carried by the rotor and engage the cam to define pumping pockets which expand and contract on rotation of the rotor. A check plate is movable along the rotational axis to communicate expanding and contracting pumping pockets. There is a cavity on one side of the cheek plate, and a fluid passage conducts fluid pressure into the cavity which fluid pressure biases the cheek plate into a position blocking the flow of fluid from the contracting pumping pockets to the expanding pumping pockets. The pump also includes a servo valve for venting the pressure in the cavity to thereby control the flow of fluid between the contracting and expanding pumping pockets. A fluid passage in the cheek plate receives flow from the contracting pockets. The passage has a portion directing flow from the contracting pumping pockets radially inwardly of the cheek plate. A tubular member is fixedly attached to the cheek plate coaxially with the axis of relative rotation of the rotor, and the interior of the tubular member communicates with the portion of the fluid passage directing flow radially inwardly.

12 Claims, 17 Drawing Figures

POWER STEERING PUMP

BACKGROUND OF THE INVENTION

The present invention relates to a pump, and particularly relates to a power steering pump for supplying fluid to a power-steering system of a vehicle.

The use of a pump for supplying power steering fluid to a steering system of a vehicle is well known. Typically, such a pump includes a cam ring, a rotor, and vanes carried by either the cam ring or rotor. The vanes act between the cam ring and rotor and define pumping pockets. On relative rotation of the rotor and cam ring, the pumping pockets expand and contract. A reservoir of fluid communicates with the expanding pumping pockets. Fluid is forced from the contracting pumping pockets to the steering system.

Such a power steering pump is driven from the engine of the vehicle. The pump must provide sufficient fluid flow to enable steering to be accomplished at a relatively low predetermined engine speed, such as during vehicle parking. Conventional power steering pumps are designed to have sufficient output at low engine speeds. Also, the conventional pumps include a mechanism to bypass flow from the steering system at pump speeds above a predetermined speed. These mechanisms avoid the pumping of steering fluid through the steering system at an increasing rate as engine speed increases. A number of such mechanisms exist. Typical pumps having such mechanisms are shown in U.S. Pat. Nos. 3,822,965 and 4,014,630. These patents disclose cheek plate unloading pumps.

It is well known that a cheek plate unloading pump bypasses the pump output flow as pump speed increases. In such a pump the cam ring, rotor, and cheek plate are all disposed within a pumping chamber in a housing. The cheek plate is biased toward the rotor and cam ring. When the cheek plate moves away from the rotor and cam ring against the bias, a flow path is created across the rotor and cam ring causing flow from the contracting pumping pockets of the pump to bypass directly to the expanding pumping pockets of the pump. The amount of flow which is bypassed is in proportion to the amount of movement of the cheek plate.

The cheek plate is biased into engagement with the cam ring and rotor by a spring and by fluid pressure in a cavity adjacent to the cheek plate. The fluid pressure in the cavity is communicated to the cavity from the contracting fluid pockets. If the pressure in the cavity is reduced by venting the cavity to the inlet of the pump, then the cheek plate moves to bypass more fluid and the flow to the system supplied by the pump decreases. On the other hand, if the pressure in the cavity increases, the cheek plate will move in a direction toward the cam ring and rotor and decrease the amount of fluid which is bypassed, and thus increase the flow to the system.

In addition to limiting the flow from the pump when pump speed exceeds a predetermined speed, it is desirable to control the flow from the pump according to the demand by the system supplied by the pump. This has been done by sensing the pressure in a conduit directing flow from the pump. This pressure, the system pressure, is relatively low when steering is not occurring. The system pressure rises during a steering maneuver. This increase in system pressure has been used as a control signal to cause a decrease in the amount of fluid bypassed, thereby increasing the flow from the pump.

U.S. Pat. Nos. 3,822,965 and 4,014,630 each disclose a cheek plate pump having a servo valve for controlling the pressure in the cavity adjacent the cheek plate. When the servo valve opens, the cavity is vented to the pump inlet. As a result, the cheek plate moves to a position in which a greater amount of fluid is bypassed.

The servo valve is controlled by fluid pressures acting on it. In particular, the servo valve is controlled by the difference between pressures on opposite sides of a control orifice, one side of which is at system pressure, and the other side of which is at the pressure just downstream of the contracting pumping pockets, i.e., the pump outlet pressure. Passages in the pump communicate system pressure and pump outlet pressure, respectively, to opposite surface portions of the servo valve. The pump also has passages for communicating the cavity pressure to the servo valve and a passage for directing the cavity pressure from the servo valve to the pump inlet for purposes of venting the cavity pressure.

Prior cheek plate unloading pumps have located the servo valve in the housing defining the pumping chamber, i.e. outside the cam ring and rotor. Hence, the housing had to be large enough not only to receive the servo valve, but also to provide the various passages for flow to and from the servo valve. Further, since system pressure acts on the servo valve, it has been common to connect the system to a passage in the housing in which the servo valve is located. This also adds to the overall size of the housing of the pump of the prior art.

SUMMARY OF THE INVENTION

The present invention relates to a pump having a cheek plate which moves to bypass fluid from the system supplied by the pump as pump speed increases above a predetermined speed and which decreases the amount of fluid bypassed in response to increasing demand for fluid by the system. Such pumps are known as cheek plate unloading pumps.

The cheek plate unloading pump of the present invention can be extremely small in size as compared to similar cheek plate unloading pumps of the prior art. Thus, the cheek plate unloading pump of the present invention is lighter in weight and can be mounted on a lighter support bracket. The pump of the present invention also requires significantly less energy to drive it than cheek plate unloading pumps of the prior art.

Specifically, the pump of the present invention involves two features which substantially reduce the size of the pump. One feature is the location of the servo valve in a cam ring, rather than in a housing part. The other feature relates to passing the outlet flow from the pump radially through the cheek plate and then through a discharge port which is coaxial with the input shaft of the pump. Because of the foregoing features, many of the passages in the prior art pumps which passages are located in housing parts which define the pumping chamber are now located in pump components which are within the pumping chamber. The present invention thus achieves a substantial reduction in the size of the pump, the weight of the pump, and the energy required for driving the pump.

DESCRIPTION OF THE DRAWINGS

Further features and advantages of the present invention will be apparent to those skilled in the art to which the invention relates upon a consideration of the following description of the invention made with reference to the accompanying drawings in which.

DESCRIPTION OF A PREFERRED EMBODIMENT

The present invention relates to a pump for supplying fluid to a system. The following description is subdivided into three sections, one providing a general description of the pump, one describing the cam ring, cheek plate and porting arrangements within the pump, and a final section describing the structure and operation of the servo-valve which controls the position of the cheek plate relative to the cam ring.

General Description

Figure 1:
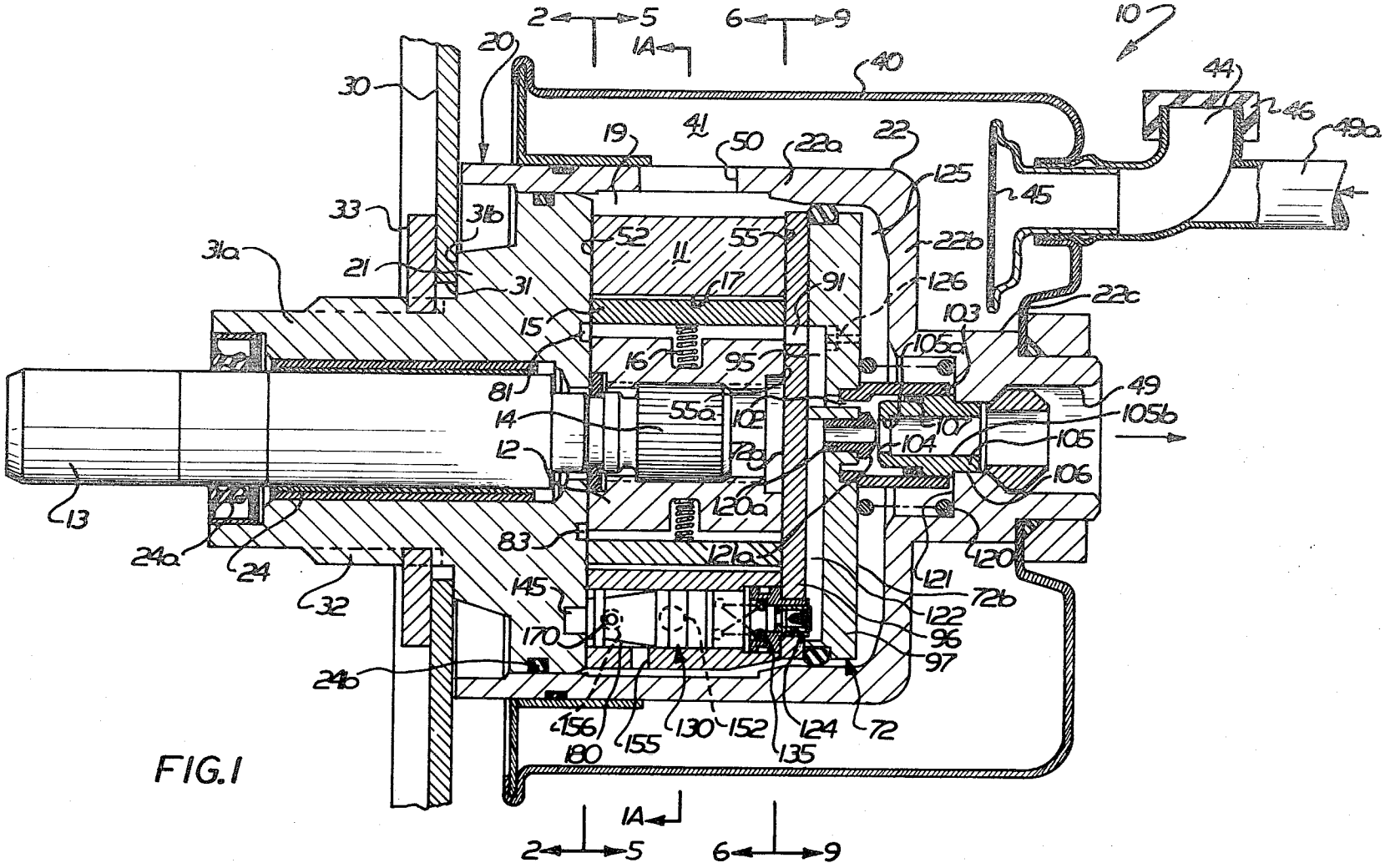
FIG. 1 is an axial cross-sectional view of a power steering pump embodying the present invention.

A vehicle power steering pump embodying the present invention is illustrated in FIG. 1 and generally designated 10. The pump 10 is adapted to supply fluid to a power steering system, such as a rack-and-pinion steering system, having an open center control valve. The pump 10 has structural features which enable the pump to be extremely small and yet provide the necessary flow.

The pump 10 is a slipper vane pump. The pump 10 includes a cam ring 11 and a rotor 12, which are relatively rotatable. Specifically, the rotor 12 is rotated by a vehicle engine driven input shaft 13, which input shaft has an end portion 14 splined to the rotor 12. The rotor 12 has a plurality of slots around its periphery. Each slot carries a vane in the form of a slipper 15. Each slipper has associated with it a spring 16 which biases the slipper into engagement with the internal periphery 17 of the cam ring 11. The slippers 15 define a plurality of pumping pockets which are spaced around the inner periphery 17 of the cam ring 11. As the rotor rotates, the pumping pockets expand and contract due to movement of the slippers radially inwardly and outwardly in the slots in the rotor 12 due to the shape of the internal periphery 17 of the cam ring 11, all as is known.

The cam ring 11, the slippers 15, and rotor 12 are all located in a pumping chamber 19. The pumping chamber 19 is defined by a housing 20. The housing 20 comprises two parts, namely a base housing member 21 and a cup-shaped housing member 22. The cup-shaped housing member 22 has a tubular portion 22*a* which encircles the cam ring 11 and receives the base housing member 21. In addition, the cup-shaped housing member 22 has a base portion 22*b* which is located at the end of the pump opposite the base housing member 21.

The input shaft 13 extends through an opening in the housing member 21 and is rotatably supported in the member 21 by a suitable sleeve bearing 24. Seals 24*a* and 24*b* prevent leakage of fluid between the housing member 21 and the shaft 13 and between the housing members 21 and 22, respectively.

The pump 10 is supported in a vehicle by a mounting bracket 30. Bracket 30 has an opening 31 in it through which a hub portion 31*a* of the base housing member 21 extends. The outer periphery of the hub portion 31*a* of the base housing member 21 is threaded at 32. A nut 33 is screwed onto the threaded portion 32 and clamps the mounting bracket 30 against a shoulder 31*b* on the housing member 21. The nut 33 clamps the pump 10 in the bracket 30. The mounting bracket 30, in turn, is suitably supported in the vehicle.

A fluid reservoir 40 is associated with the pump 10. The fluid reservoir 40 is in the form of a container which encircles the housing member 22, and which defines a chamber 41 around the housing member 22 for retaining power steering fluid. A suitable fill opening 44 is provided for replacement of power steering fluid which may be lost during operation of the vehicle. Associated with the fill opening 44 is a cap 46. A return line fitting 49*a* directs spent fluid into the reservoir through a screen 45.

When the vehicle engine is operating, shaft 13 is driven by the engine and the pump 10 pumps fluid. The fluid flows from the reservoir chamber 41 through passages to be described below into the expanding fluid pockets of the pump and then from the contracting fluid pockets to the pump discharge port 49. The discharge port 49 is located coaxially with the input shaft 13. After flowing through the system supplied by the pump 10, the fluid re-enters the reservoir 40 through return line 49*a*.

Cam Ring, Cheek Plate and Porting

The flow from the chamber 41 to the expanding fluid pockets is through at least one opening 50 through the tubular portion 22*a* of the housing member 22. As shown in FIG. 1, the opening 50 is located outside the circumference of the cam ring 11 and between the radially extending side surfaces 52 and 55 of the cam ring 11. Fluid flows through the opening 50 and into the portion of the pumping chamber 19 which encircles the cam ring 11. This arrangement provides a short flow path from the reservoir chamber 41 to the pumping chamber 19, from which fluid is drawn into the expanding pumping pockets as is described below.

Figure 6:
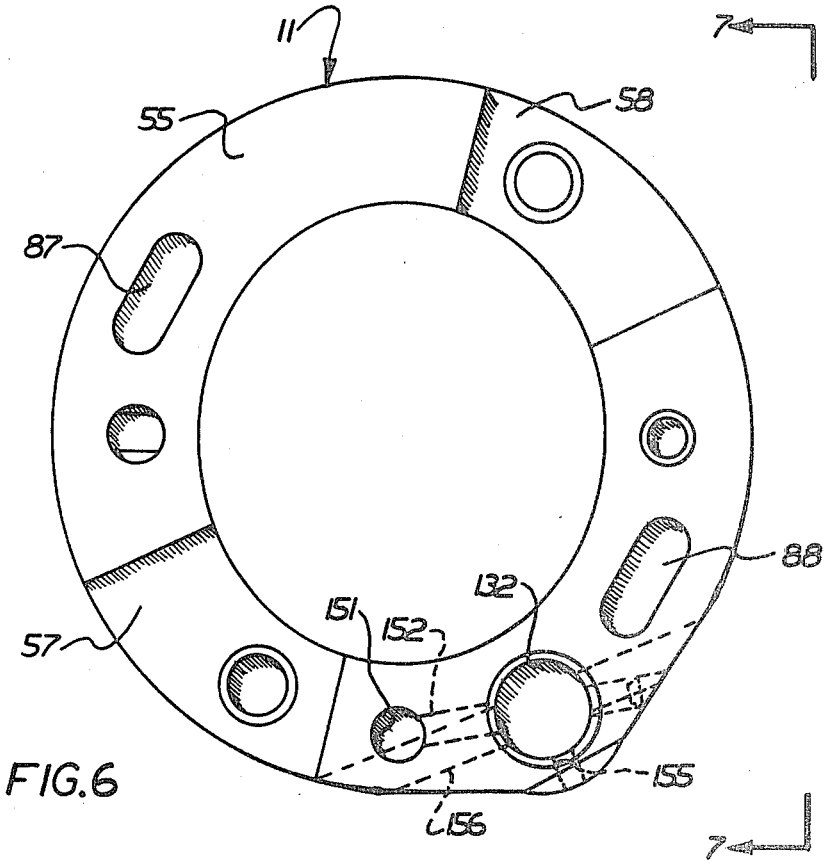
FIG. 6 is a view of a part of the pump shown in FIG. 1 looking at the part as indicated by the arrows 6—6 of FIG. 1.
Figure 5:
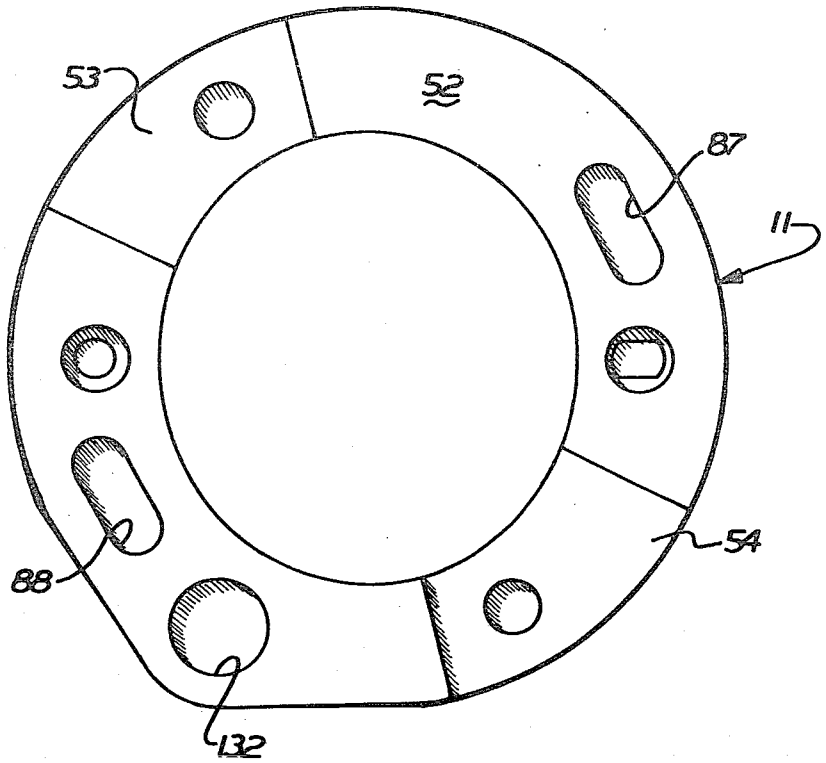
FIG. 5 is a view of a part of the pump shown in FIG. 1 and looking at the part in the direction indicated by the arrows 5—5 of FIG. 1.
Figure 8:
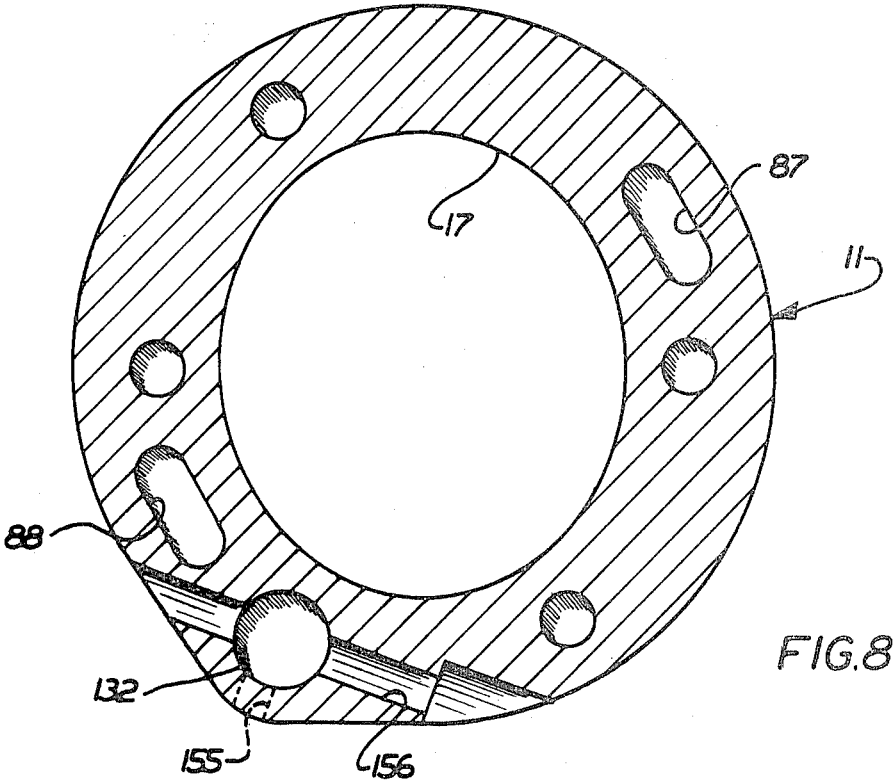
FIG. 8 is a sectional view of the part shown in FIG. 7 taken approximately along the section line 8—8 of FIG. 7.

On the radially extending surface 52 (FIG. 5) of the cam ring 11 are formed a pair of slots 53, 54 which are diametrically opposite each other. Slots 53, 54 extend radially across the surface 52 of the cam ring 11 and communicate with pumping chamber 19 to permit fluid to flow radially across the surface 52 of the cam ring. As shown in FIG. 6, the radially extending surface 55 of the cam ring 11 opposite surface 52 also has a pair of slots 57, 58 which permit fluid to flow radially across surface 55.

Figure 2:
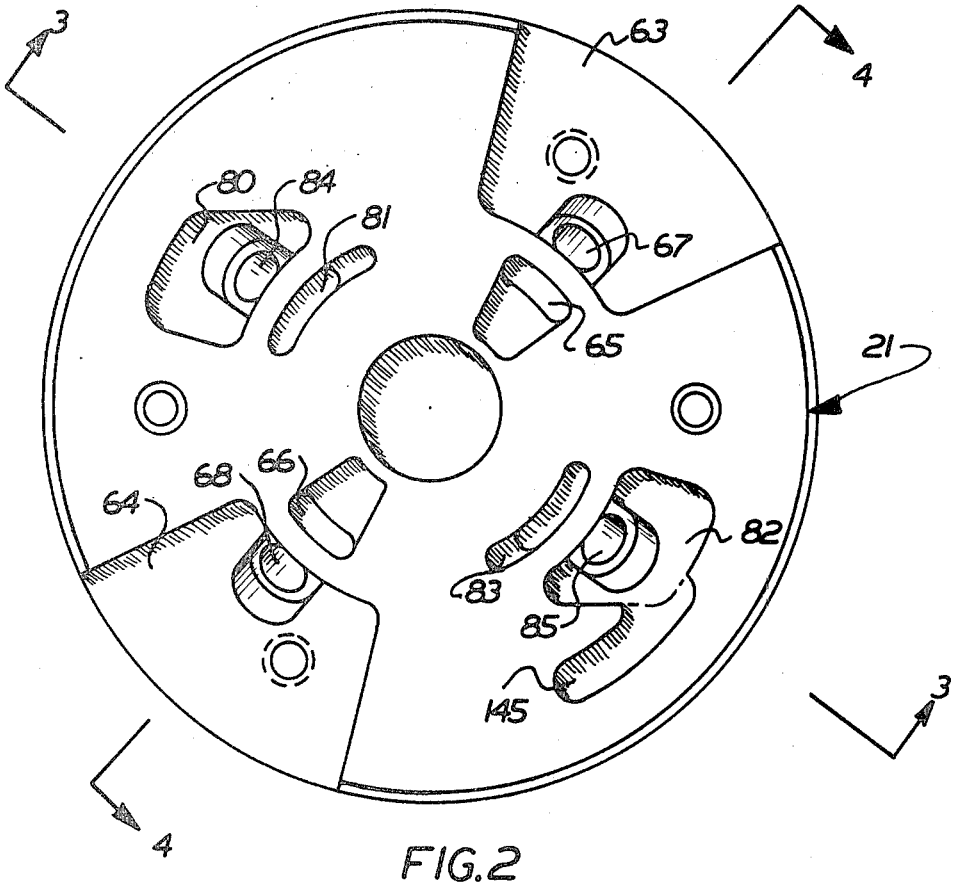
FIG. 2 is a view of a part of the pump of FIG. 1 looking in the direction indicated by the arrows 2—2 in FIG. 1.
Figure 4:
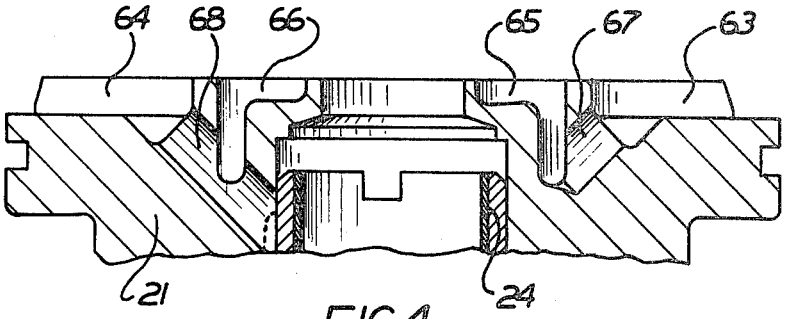
FIG. 4 is a sectional view of the part shown in FIG. 2 taken approximately along the section line 4—4 of FIG. 2.

Slots 53, 54 of the cam ring 11 face inlet ports 63, 64 formed in the housing member 21 (see FIG. 2). The ports 63, 64 communicate with inlet ports 65, 66, which are located in the housing member 21 radially inwardly of the ports 63, 64. The ports 65, 66 are positioned radially inward of the ports 63, 64 and the ports 63, 64, 65 and 66 are located generally along the same diameter of the housing member 21. The ports 65, 66 admit fluid to the pumping pockets in the rotor 12 radially inwardly of or underneath the slippers 15. As best shown in FIG. 4, port 63 communicates with the port 65 through a passage 67 in the housing member 21. Port 64 communicates with the port 66 through a passage 68 in the housing member 21. The passage 68 also supplies fluid to lubricate shaft 13 and bearing 14.

The slots 57, 58 (FIG. 6) in the cam ring 11 face inlets ports 70, 71, respectively. (FIG. 9) in a cheek plate 72. Cheek plate 72 is located adjacent surface 55 of the cam ring 11 and a coplanar surface 55*a* of the rotor 12. Surfaces 55 and 55*a* are opposite the surfaces of the cam ring 11 and rotor 12 adjacent to which the housing member 21 is located. Ports 73, 74 are disposed generally along the same diameter of the cheek plate 72 and radially inwardly of the ports 70, 71. Like the ports 65, 66 in the housing member 21, the ports 73, 74 supply inlet fluid beneath the slippers 15. The ports 73, 74 communicate with the ports 70, 71, respectively, through passages 75, 76, respectively, (See FIGS. 9, 10 and 11) located within the cheek plate 72.

The ports 70, 73, 71 and 74 are located axially opposite the ports 64, 66, 63 and 65, respectively, in the housing member 21. The cheek plate 72 and housing member 21 are located so that the ports 70, 73, 71, 74, 64, 66, 63 and 65 are adjacent the portion of the cam ring 11 which defines pumping pockets that are expanding as the rotor 12 rotates. From the above it should be clear that as the pump operates, fluid is communicated from the reservoir chamber 41 to the pumping chamer 19, and from the pumping chamber 19 to the various inlet ports, and is drawn into the expanding pockets of the pump as the slippers move past the ports. The pressure in the various inlet ports 63, 64, 65, 66, 70, 71, 73 and 74 is the same and is termed herein as the inlet pressure.

Figure 3:
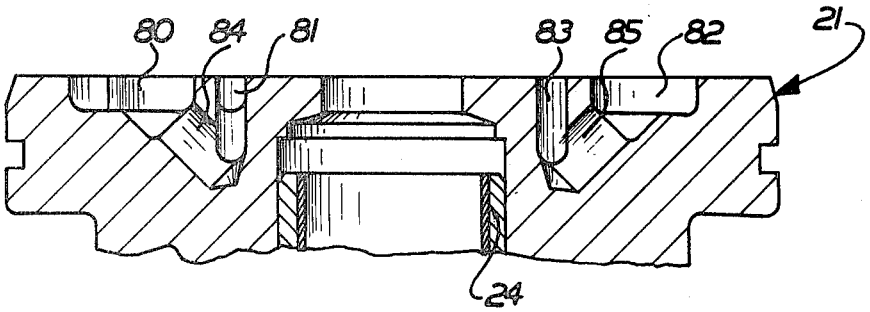
FIG. 3 is a sectional view of the part shown in FIG. 2 taken approximately along the section line 3—3 of FIG. 2.

As discussed above, fluid which is drawn into the expanding pockets of the pump is forced out of the pockets as they contract. The flow of fluid out of the contracting pockets of the pump is from opposite sides of the cam ring 11. Specifically, from one side of the contracting pockets, fluid flows into diametrically opposed outlet ports 80, 81 and 82, 83 in the housing member 21 (See FIG. 2). The ports 80 and 81 are interconnected by an internal passage 84 (FIG. 3) in the housing member 21. The ports 82, 83 are interconnected by an internal passage 85 in the housing member 21. The ports 81, 83 are located radially inwardly of the ports 80, 82, respectively, and receive fluid expelled from beneath the slippers 15.

Figure 7:
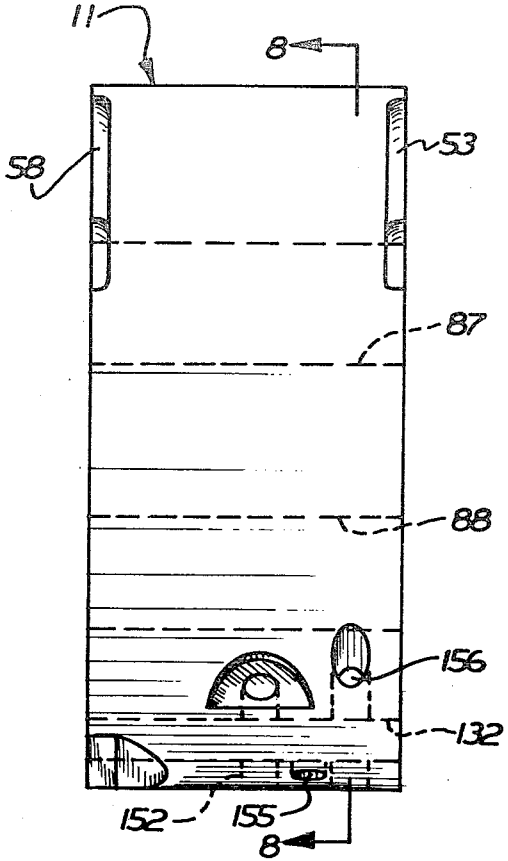
FIG. 7 is a view of the part shown in FIG. 6 looking at the part shown in FIG. 6 as indicated by the arrows 7—7.

The flow from the ports 80, 81, 82, and 83 is directed through the cam ring 11 to the surface 55 of the cam ring adjacent to the cheek plate 72. To this end, the cam ring 11 has passages or conduits 87, 88 (FIGS. 5 and 7) which extend axially through the cam ring and which lie adjacent to and in facing relation to the ports 80, 82, respectively, in the housing member 21 (FIG. 2). Thus, the flow from adjacent the surface 52 of the cam ring 11 is directed through the passages 87, 88 toward the cheek plate 72.

Figure 9:
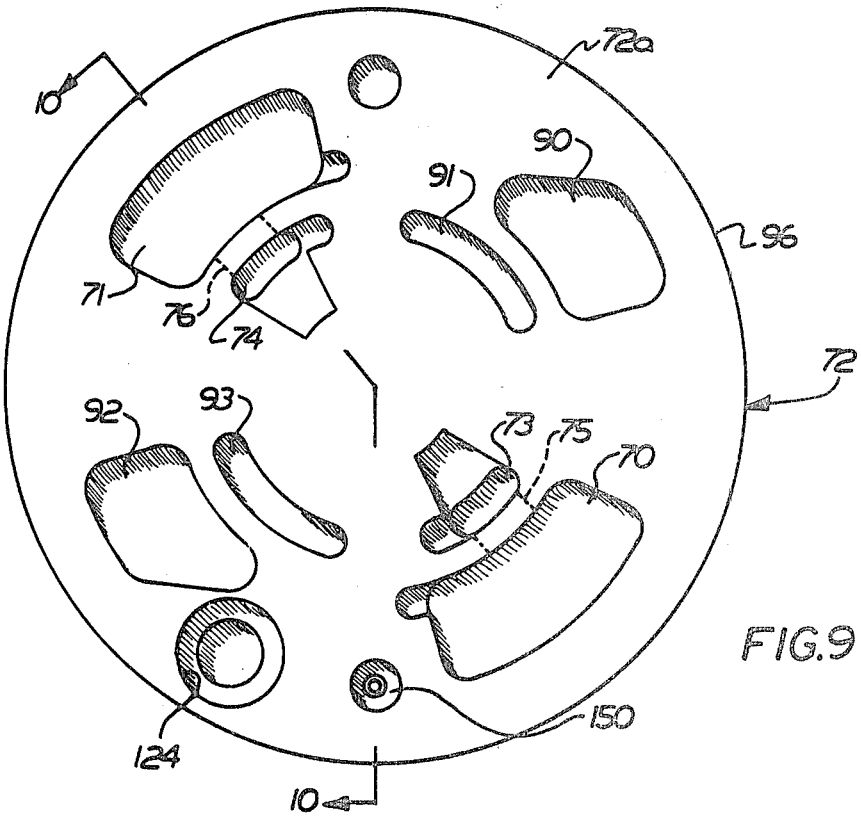
FIG. 9 is a view of still another part of the pump of FIG. 1 looking at the part in the direction indicated by the arrows 9—9 of FIG. 1.

Flow from the contracting pockets of the pump is also directed from the pockets into ports 90, 91, 92 and 93 of the cheek plate 72 (see FIG. 9). The port 91 is located radially inwardly of the port 90, and the port 93 is located radially inwardly of the port 92. The ports 90, 91, 92 and 93 are all interconnected by a passage or chamber 95 (see FIGS. 1 and 11) located internally of the cheek plate 72. Moreover, passages 87, 88 in the cam ring 11 communicate with ports 90, 92 (FIG. 9), respectively, in the cheek plate 72. Therefore, all of the outlet flow from the contracting pumping pockets is collected in chamber 95. The pressure in the chamber 95 is termed herein the outlet pressure of the pump.

Figure 11:
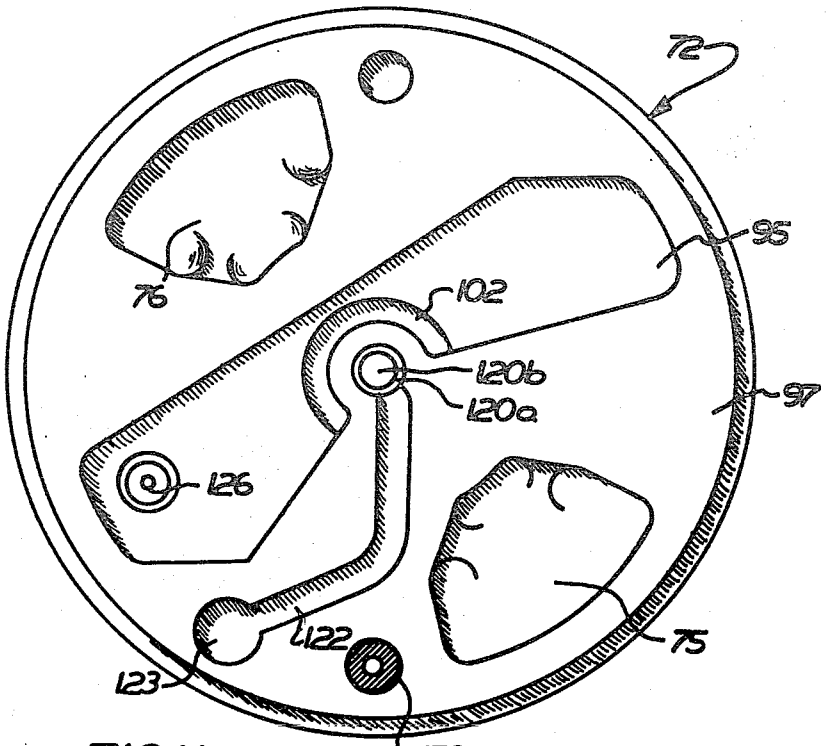
FIG. 11 is a sectional view of the part of FIG. 10 taken approximately along the line 11—11 of FIG. 10.
Figure 10:
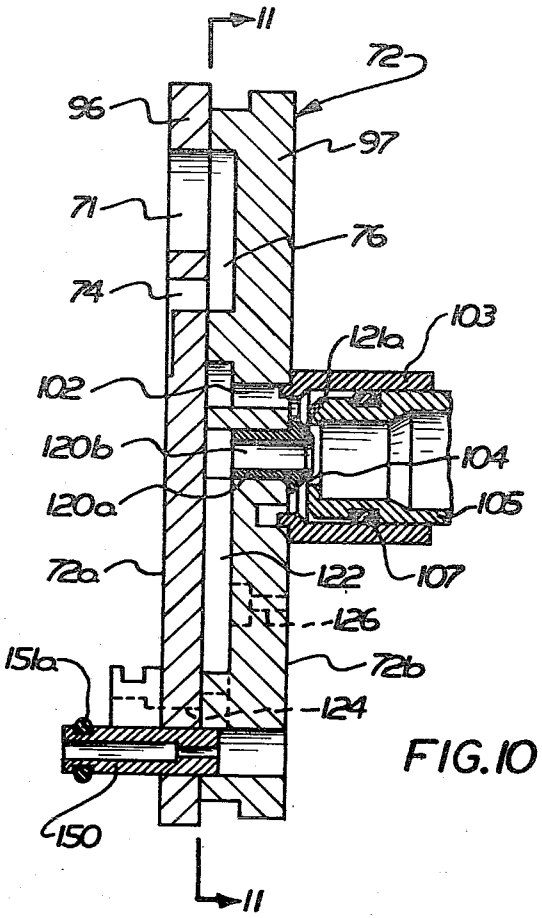
FIG. 10 is a cross-sectional view of the part shown in FIG. 9, taken approximately along the section line 10—10 of FIG. 9.

The cheek plate 72 is made up of a pair of plate members 96, 97 (see FIG. 10). The plate member 96 has formed in it the outlet ports 90, 91, 92 and 93, as well as the inlet ports 70, 73, 71 and 74, as shown in FIG. 9. As best seen in FIG. 11, the plate member 97 has formed in it the passage or chamber 95 and passages 75, 76.

The discharge port 49 (FIG. 1) is coaxial with the input shaft 13 and the flow from the chamber 95 in the cheek plate 72 is directed through the discharge port 49 of the pump. Specifically, the flow from the chamber 95 is directed through an arcuate passage 102 formed in the plate 97 (see FIG. 11). From the passage 102, the flow is directed into the interior of a tubular member 103 (see FIG. 1), which communicates with the passage 102. The flow is then through an orifice 104. Flow from the orifice 104 passes into a tubular member 105. The tubular member 105 is press fit at 106 into the hub 22*c* of the cup-shaped housing member 22. The flow from the member 105 passes through the discharge port 49 of the pump to the fluid system supplied by the pump. The pressure in the discharge port 49 is termed herein system pressure. As will be discussed below, there is relative axial movement between tubular members 103 and 105. A seal 107 prevents leakage between tubular members 103 and 105.

It should be apparent from the description hereinabove that the flow from the contracting pumping pockets is combined in the chamber 95 in the cheek plate 72. The combined flow is directed radially inwardly of the cheek plate 72 and then axially from the pump through the discharge port 49. This flow path minimizes the flow passages in the housing parts and thus enables the housing parts to be made small and light weight.

The orifice 104 is the main flow control orifice in the pump. The pressure drop across the orifice 104 controls the axial position of the cheek plate 72 relative to the cam ring 11, rotor 12 and housing 22. The pressure upstream of the orifice 104 is the pump outlet pressure, i.e., pressure in chamber 95. The pressure downstream of the orifice 104 is system pressure, and it is generally less than the pump outlet pressure because of the pressure drop across orifice 104. However, as will be readily understood by those skilled in the art, conditions in the system supplied by the pump 10 cause the system pressure to vary. Specifically, if the system supplied by the pump 10 is a power steering system with an open center control valve, the system pressure varies with changes in demand. In such a system the system pressure is low when the demand for power assistance is low, and the system pressure increases as demand increases.

In the description above, reference was made to "inlet pressure", "outlet pressure" and "system pressure". Inlet pressure was defined as the pressure in the inlet ports 63, 64, 65, 66, 70, 71, 73, and 74. Outlet pressure was defined as the pressure in the chamber 95, and system pressure was defined as the pressure in the discharge port 49. In the description that follows these terms are used also to refer to the pressures in various locations which have unrestricted fluid communcation with the defined areas and in which the pressures are therefore very nearly equal to the defined pressures.

Servo Valve

The pump of the present invention is designed so that as pump speed increases above a predetermined speed, flow to the system does not correspondingly increase. The pump delivers a flow sufficient to provide power assistance during steering maneuvers in which the engine and the pump are turning relatively slowly, e.g. during vehicle parking. When pump speed increases above that predetermined speed, flow to the system is not correspondingly increased.

As pump speed increases above the predetermined speed, the pump of the present invention operates to bypass flow from the system by allowing fluid to flow directly from the contracting pumping pockets to the expanding pumping pockets. This bypass of flow is effected by movement of the cheek plate 72 (FIG. 1) away from the cam ring 11 and rotor 12. When the cheek plate 72 moves away from the cam ring 11 and rotor 12, fluid flows directly from the ports 90, 92 (FIG. 9) to the ports 70, 71 of the cheek plate 72. The amount of fluid that is bypassed is directly proportional to the distance the cheek plate moves away from the cam ring 11 and rotor 12.

The cheek plate 72 (FIG. 1) moves in response to changes in the forces which act on it. The forces acting on the cheek plate include the force of a spring 120 which acts between the cheek plate 72 and a shoulder 121 on the housing member 22. The spring 120 urges the cheek plate toward engagement with surfaces 55 and **55*a* of the cam ring 11 and rotor 12**, respectively, and thus into a position where no flow of fluid is bypasssed from the pump inlet to the pump outlet.

Acting in conjunction with the spring 120 to urge the cheek plate 72 into position adjacent the cam ring 11 and rotor 12 is a fluid pressure force exerted by fluid pressure in a cavity 125. Fluid pressure is communicated to the cavity 125 through an orifice 126 (FIG. 11) located in the cheek plate 72. (The orifice 126 is also shown in FIG. 1, in which it has been moved circumferentially from its true location for purposes of clarity.) Acting against the force of the spring 120 and the pressure force of fluid in the cavity 125 and tending to move the cheek plate 72 away from the cam ring 11 and rotor 12 is the force of the fluid pressure exerted on the face **72*a* (FIG. 1) of the cheek plate 72** by the fluid being squeezed by the contracting pumping pockets.

The pressure in the cavity 125 is controlled by a servo valve 130. When the servo valve 130 closes, an increase in pressure occurs in the cavity 125, which urges the cheek plate 72 toward the cam ring 11 and rotor 15. When the servo valve 130 opens, it vents the pressure in the cavity 125. Venting the cavity 125 reduces the pressure in the cavity and the cheek plate 72 moves away from the cam ring 11 and rotor 12.

The servo valve 130 incorporates a spool 131 (FIG. 12) which is located in a chamber 132 in the cam ring 11. The chamber 132 extends parallel to the axis of rotation of shaft 13 and rotor 12. The spool 131 moves in response to changes in the pressure differential which acts across the spool 131.

Figure 12:
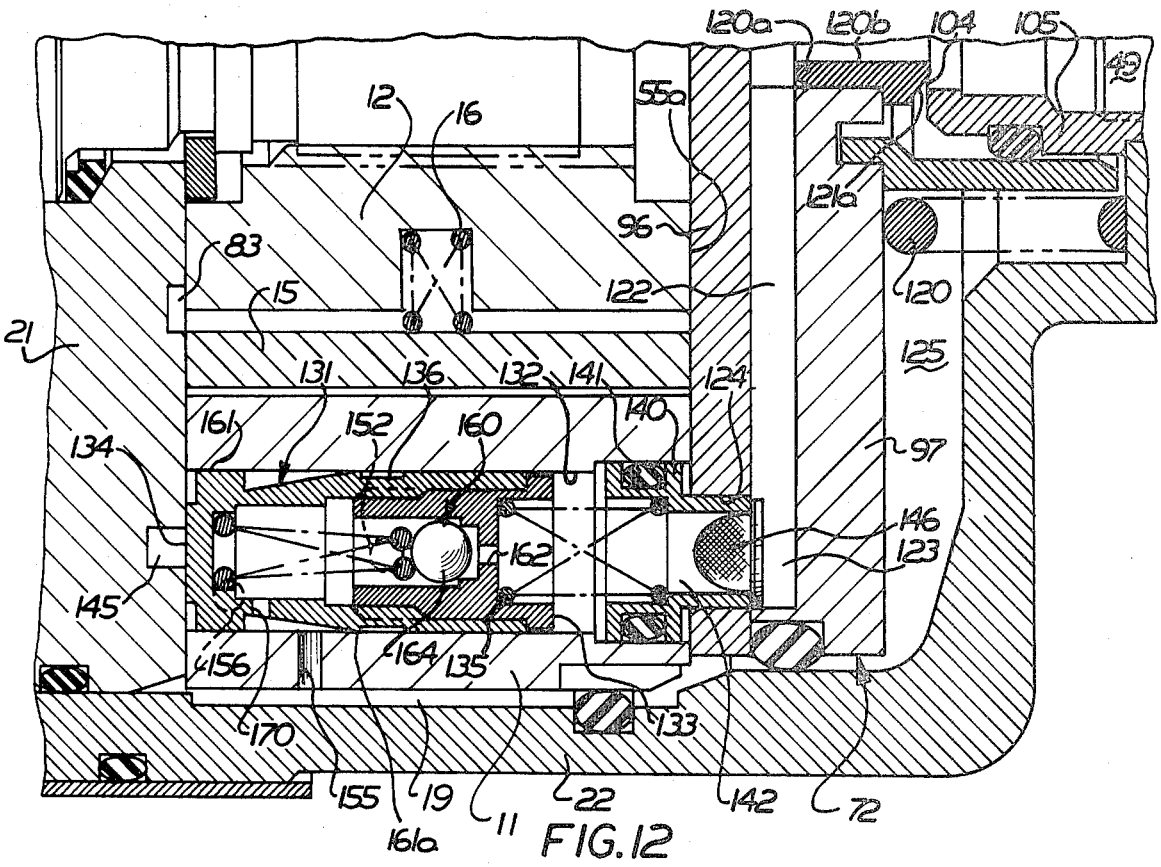
FIG. 12 is a fragmentary sectional view of the pump of FIG. 1 on an enlarged scale and shown somewhat schematically.

One pressure acting on the spool 131 (FIG. 12) is system pressure. System pressure from the discharge port 49 is communicated to end face 133 of the spool 131 through the cheek plate 72. Specifically, system pressure is communicated to a plug **120*a* (FIGS. 1 and 11 and 12). The plug 120*a* is press fit into the plate member 97 of the cheek plate 72. Extending through the plug 120*a* is a passage 120*b* which communicates with one end of a radially extending passage 122 in the plate member 97. As shown in FIG. 11, the passage 122, while it extends radially, actually has a dog-leg shape. The end portion of the passage 122 remote from the passage 120*b* is generally circular in shape and is designated 123, as shown in FIG. 11. The end portion 123 of the passage 122 communicates with a passage or opening 124 (FIG. 12) in the plate member 96. The passage 124 communicates with the chamber 132 formed in cam ring 11. Fluid pressure in chamber 132 acts on an end face 133 of the spool 131 and urges the spool 131 to the left as viewed in FIG. 1**.

Fluid communication between chamber 132 and the end portion 123 of passage 122 is through a fluid communication member 140 (FIG. 12). The member 140 is press fit into the cheek plate 72 and extends into the chamber 132. The member 140 moves with the cheek plate 72 and is slidable relative to the cam ring 11. An O-ring seal 141 encircles the member 140 and maintains a seal between the cam ring 11 and the member 140. The member 140, as can be seen in FIG. 12, has formed in it a fluid passage 142. Therefore, the fluid pressure in passage 122 is communicated through the passage 142 and into the chamber 132 to act upon end face 133. A suitable screen member 146 is located into in the passage 142 to filter out any debris or particles whch may be in the fluid flowing into the chamber 132. The passages which communicate pressure from the discharge port 49 to act on end face 133 of the spool 131 are relatively large so that changes in pressure are communicated freely from the discharge port to the end face 133 of the spool.

The outlet pressure of pump 10 is communicated to the left side of the spool 131 and acts upon end face 134 of the spool 131. Specifically, the housing member 21 (FIG. 2) is provided with a passage portion 145 which connects with the outlet port 82. The passage portion 145 extends circumferentially from the outlet port 82 and overlies the chamber 132 in the cam ring 11. As a result, the outlet fluid pressure is communicated to the chamber 132 and acts on the left face 134 of the spool 131 urging the spool to the right as shown in FIGS. 1 and 12.

In addition to the fluid pressures which act on opposite end faces 133 and 134 of the spool 131, a biasing spring 135 also acts on the spool. Spring 135 is positioned between the member 140 and the end face 133 and supplements the pressure acting on face 133 tending to move the spool 131 to the left as viewed in FIG. 12.

Figure 1A:
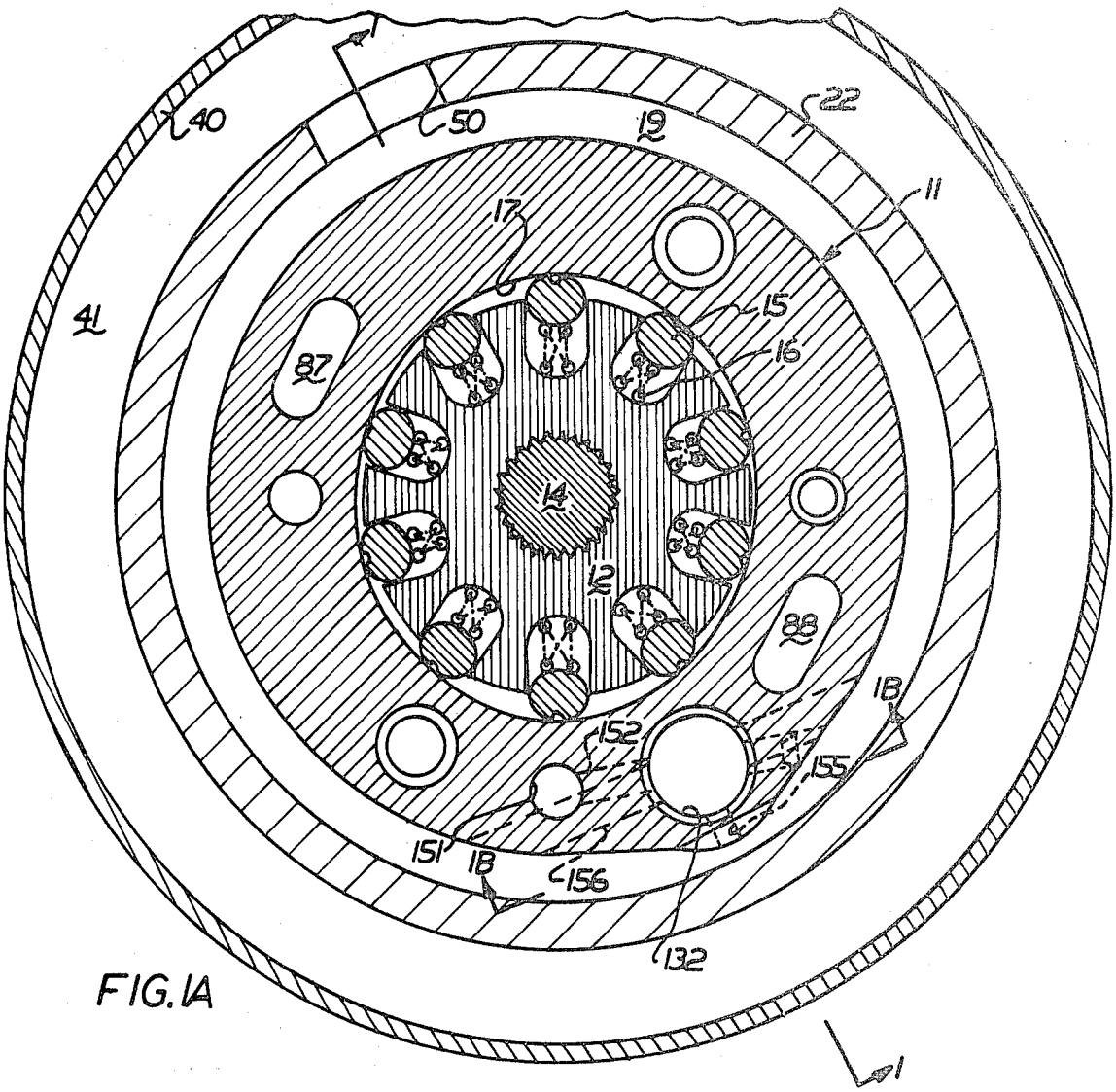
FIG. 1A is a view of the pump of FIG. 1 looking in the direction indicated by the arrows 1A—1A in FIG. 1.
Figure 1B:
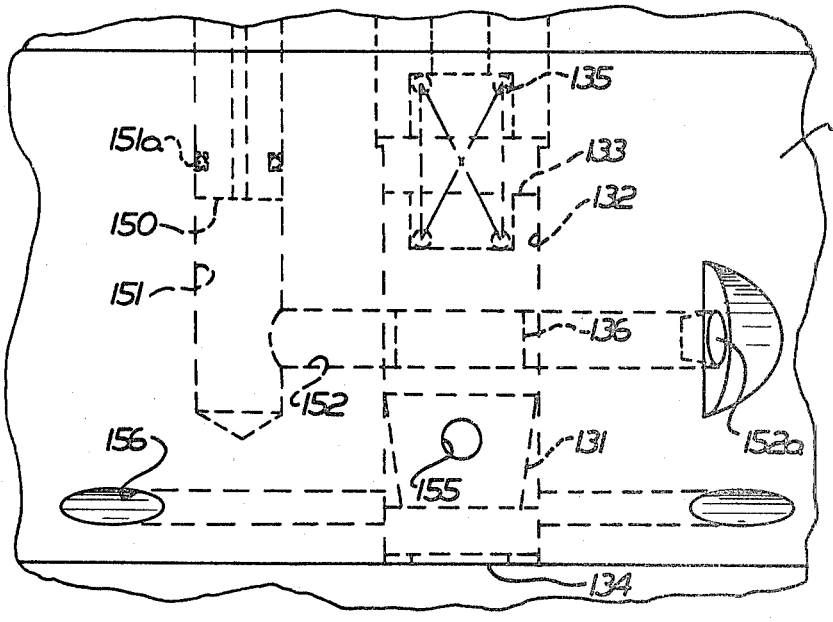
FIG. 1B shows a portion of the pump shown in FIG. 1 viewed generally in the direction indicated by the arrows 1B—1B in FIG. 1A.

Movement of the spool 131 changes the pressure in the cavity 125 which acts on the cheek plate 72. Fluid communication between the cavity 125 and the spool valve 131 is effected by a tubular member 150 (see FIGS. 1B and 10). The tubular member 150 is press fit into the cheek plate 72. The tubular member 150 is slidably received in a passage 151 (FIGS. 1B and 6) formed in the cam ring 11. A seal 151*a* (FIG. 10) encircles tubular member 150 to prevent leakage when the member slides in the passage 151.

The passage 151 communicates with a passage 152 (FIGS. 1A and 1B) which extends through the cam ring 11 along a chord of the cam ring 11. One end of the passage 152 opens onto the outer periphery of the cam ring 11 where it is sealed by a plug 152*a*. The passage 152 intersects the chamber 132. As a result, the pressure in the cheek plate cavity 125 is communicated by the passage 152 to the lateral periphery of the spool 131.

A circumferential groove 136 (FIG. 12) formed in the valve spool 131 is aligned with the opening of passage 152 into chamber 132. The groove 136 distributes the fluid pressure from passage 152 evenly around the perimeter of the spool 131 to reduce the possibility that the valve spool will stick. Also communicating with the chamber 132 (FIGS. 6 and 7) are passages 155, 156 (FIGS. 1A, 1B, 7 and 8), both of which communicate with the pumping chamber 19. Passages 155 and 156 both extend chordally of the cam ring 11 and, as best seen in FIG. 13, are axially offset from each other and from passage 152 along the length of passage 132.

When the engine of the vehicle starts operating, the pump 10 is driven and operates to pump fluid from the reservoir 41 (FIG. 12) through the discharge port 49 of the pump into the system. Initially, the cheek plate 72 is biased by the spring 120 into engagement with the cam ring 11 and rotor 12. All of the output of the pump is therefore directed to the fluid system supplied by the pump. During this time, fluid at outlet pressure is communicated to the spool 131 through passage 145 to urge the spool to move toward the right as shown in FIG. 12. As pointed out above, system pressure is communicated to face 133 of spool 131 and tends to oppose the outlet pressure. When the outlet pressure in passage 145 is not sufficient to overcome the net force urging spool 131 to the left (spring 135 plus system pressure force), the cavity 125 is not vented. Therefore, the pressure force acting on face 72*a* of the cheek plate 72 does not exceed the net force (pressure force plus spring force) acting on face 27*b* of the cheek plate, and the cheek plate does not allow any fluid to be bypassed. Assuming no change in system pressure, once the pump speed reaches a predetermined speed, the outlet pressure force acting on spool face 134 will be effective to move the spool 131 to the right, thereby venting the pressure in cavity 125. The predetermined speed is selected by selection of the stiffness of spring 135.

The servo valve 130 also responds to changes in demand for fluid as reflected in changes in system pressure. System pressure varies according to the demands of the system supplied by the pump 10 and increases with increasing demand. The cross sectional flow area of orifice 104 and the spring constant of spring 135 are selected so that when the pump speed exceeds the predetermined speed and under conditions of no demand from the system, the net force tending to move the spool 131 to the left as viewed in FIG. 12 is less than the force of outlet fluid pressure tending to move the spool 131 to the right. Accordingly, when there is no demand from the system and the pump speed exceeds the predetermined speed, the servo valve moves to a position illustrated in FIG. 13 in which the chamber 125 is communicated with the pumping chamber 19. Because the pumping chamber 19 is at the relatively low inlet pressure, while the chamber 125 is at a relatively high outlet pressure, communication between the chambers relieves the pressure in chamber 125. The fluid pressure acting against the surface 72*a* of the cam plate 72 can then overcome the force of spring 120 and move the cheek plate 72 away from the cam ring 11.

Figure 13:
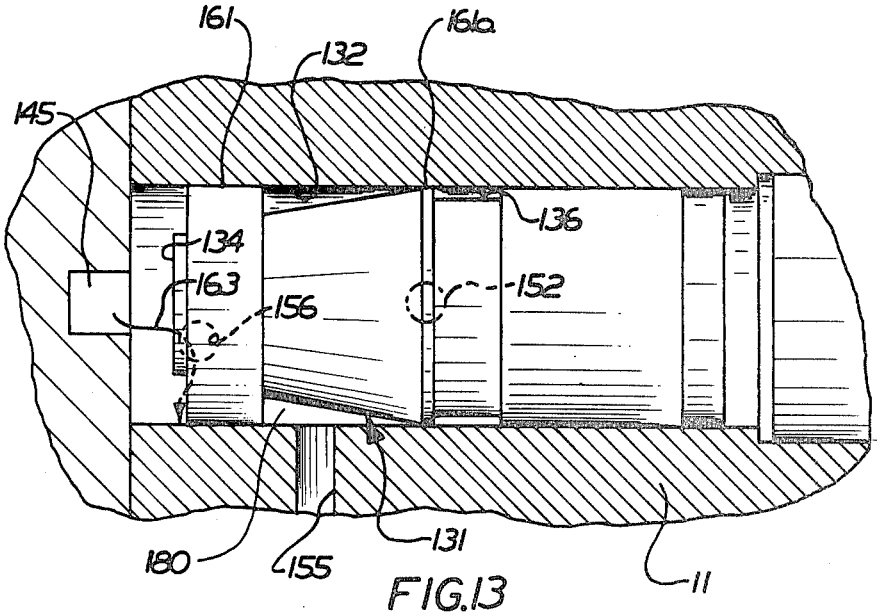
FIG. 13 is a view of parts of the pump of FIG. 1 shown in an operating position.

When the valve spool 131 moves to the position shown in FIG. 13, a land 161*a* on the spool is moved to a position permitting communication between passages 155 and 152. Fluid can thereby flow from the cavity 125 through the tubular member 150, passages 151, 152, into the area 180 of the chamber 132 surrounding the spool 131 and then through the passage 155 to the pumping chamber 19. This flow vents the cheek plate cavity 125 with the result described above.

When the valve spool 131 is positioned as shown in FIG. 13, the land 161 on the spool partially uncovers the opening of passage 156 into chamber 132. As a result, some fluid, as indicated by the arrow 163, flows past the land 161 and through the passage 156 into the pumping chamber 19. The fluid flow 163 is small and is intended to stabilize the spool 131. The function and operation of such a stabilizing flow is described in detail in U.S. Pat. No. 4,014,630, which is incorporated by reference herein. The stabilizing flow only slightly reduces the flow of fluid to the system.

The flow created after the land 161*a* uncovers the passage 152 vents the cheek plate cavity 125. The distances between the various passages 155, 156 and lands 161, 161*a* are established so as to insure that the cheek plate cavity 125 is vented prior to creating the stabilizing flow.

After the spool 131 has been moved to the position shown in FIG. 13, the spool can move slightly or modulate about that position in order to control accurately the flow of fluid to the system as pump speed increases or decreases and in accordance with the demand for fluid by the system as reflected by increases or decreases, respectively, in system pressure. For example, if the fluid pressure in the system increases (reflecting an increase in demand), there would be an instantaneous reduction in flow through the orifice 104. As a result, the difference between the pressures acting on the opposite ends of the spool 131 would be reduced. Thus, the spool 131 would tend to move toward the left as shown in FIG. 12. Such movement would reduce the venting of the cheek plate cavity 125 and therefore increase the pressure in the cheek plate cavity 125. The increased pressure in cavity 125 would move the cheek plate 72 into a position closer to the rotor 12 and cam ring 11 and cause an instantaneous increase in the flow to the system.

Similarly, if engine speed increased, with a corresponding increase in pump speed, an instantaneous increase in flow through the orifice 104 would occur. As a result, the pressure drop across the orifice 104 would increase. The difference between the fluid pressures acting on the opposite ends 133, 134 of the spool 131 would also increase, and the spool would move to the right, as shown in FIG. 13, to vent the pressure in the cheek plate cavity 125. The cheek plate would move to the right as viewed in FIG. 1 and thereby cause a greater amount of fluid to be bypassed. Thus, there would be no increase in the flow to the system.

The servo valve 130 contains within it a pressure relief valve 160 for limiting maximum system pressure in the event of an unexpected pressure increase. The servo valve spool 131 is hollow and has an orifice 162 formed in its end surface 133. The orifice 162 communicates through passages 142, 123, 122 and **120*b* to the discharge orifice 49 and is therefore always at system pressure. Near the opposite end of the spool 131, an orifice 170 is formed in the side wall of the spool. The orifice 170 communicates the interior of the servo valve spool 131 with the passage 155 and the pumping chamber 19, which is always at the pressure of the reservoir chamber 41, i.e., inlet pressure. A ball 164 is spring biased against the interior surface of the end wall of spool 131 to seal the orifice 162. If system pressure rises above a predetermined maximum, the ball 164 will be forced away from the end wall of the spool 131 thereby opening the orifice 162** and relieving the excess pressure.

Figure 15:
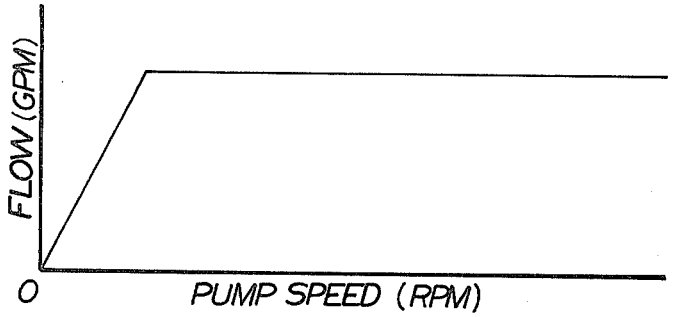

From the above, it should be clear that the operation of the pump 10 could be in accordance with the graph of FIG. 15. In FIG. 15, the flow of fluid to the system increases as pump speed increases up to a predetermined speed. As pump speed increases above the predetermined speed, the amount of flow to the system is maintained substantially constant. Such a constant flow from the pump 10 is maintained by the servo valve 130 controlling the pressure in the cavity 125 and thus controlling the position of the cheek plate 72.

Figure 14:
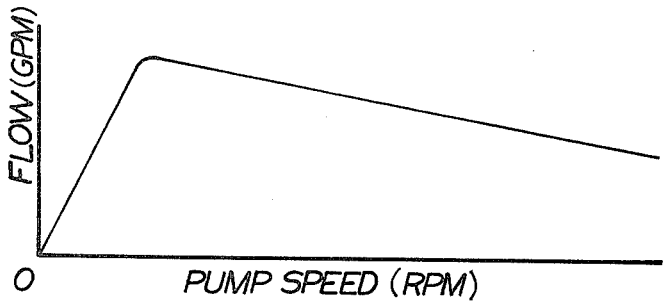
FIGS. 14 and 15 are graphs showing operational characteristics of a pump embodying the present invention.

The pump 10 could also be operated to reduce fluid flow to a power steering system as pump speed increases above a predetermined speed. In accordance with the graph of FIG. 14, as pump speed increases up to a predetermined speed, the flow of fluid to the system increases. Thereafter, as pump speed increases, the flow of fluid to the system actually decreases from the flow at the predetermined speed. The desirability of such pump operation is well known and is discussed, for example, in U.S. Pat. No. 3,403,630.

A reduction in fluid flow at pump speeds above a predetermined speed can be provided in a simple and effective manner. Specifically, the orifice 104 (FIG. 1), which controls the pressure drop across the servo valve 130, is variable in cross sectional flow area. The variability of the orifice 104 results from the tapered shape of the nose **121*a* of the plug 120*a* and the relative movement that occurs between the plug and the tubular member 105. Specifically, as the plug 120*a* moves relative to the tubular member 105, due to movement of the cheek plate 72, the area of the orifice 104 defined by the tubular member 105 and the tapered surface 121*a* of the plug 120*a* is varied. The tubular member 105 has a stepped internal configuration. The upstream diameter 105*a* is smaller in diameter than the downstream portion 105*b*. This assures that throttling of the flow occurs at the variable orifice 104 and that the effects of flow conditions downstream of the orifice 104** are small.

As pump speed increases, the force acting to move the cheek plate 72 to the right as shown in FIG. 1, also increases. If the cheek plate 72 does move to the right as viewed in FIG. 1, fluid flows from contracting to expanding pockets across the surface of the cheek plate bypassing the system and the area of the orifice 104 is reduced. Reduction in the area of orifice 104 increases the difference between the fluid pressure upstream (outlet pressure) and the pressure downstream of the orifice (system pressure). As a result, the difference between the pressure acting on the face 134 and the face 133 of the servo valve 130 is increased over what it would have been if the area of orifice 104 had not changed. The higher pressure difference causes the spool 131 to move to the right, as viewed in FIG. 1, to a greater extent than it would if the orifice 104 had not changed in area. The servo valve 130 therefore vents the cheek plate cavity 125 to a greater extent, and the cheek plate 72 moves to a greater extent. The cheek plate 72 therefore bypasses a greater amount of fluid from the system than it would have bypassed had the orifice 104 not changed in area. The net result is a substantial reduction in flow of fluid to the system.

The concept of reducing the area of the orifice 104 as the cheek plate 72 moves is the invention of Gilbert H. Drutchas only and a patent application, Ser. No. 261,645, directed to his invention is being filed concurrently with the present application. Mr. Drutchas' invention is disclosed in the present application in order to show the best mode of practicing the present invention. The present inventors, namely, Mr. Drutchas and Mr. Suttkus, did not contemplate the use of a variable orifice for providing a droop or reduction in fluid flow to the fluid system as pump speed increases above a predetermined speed.

What is claimed is:

1. A pump for supplying fluid from a reservoir to a system comprising a rotor member, a cam member encircling said rotor member, means for effecting relative rotation of said cam and rotor members about an axis, a plurality of vanes carried by one of said cam and rotor members, said vanes engaging the other of said members and defining pumping pockets which expand and contract on relative rotation of said members, a cheek plate extending radially of the rotational axis and disposed adjacent one side of said rotor member and said cam member, said cheek plate being movable along the rotational axis to communicate expanding and contracting pockets, means defining a cavity on one side of said cheek plate, a first fluid passage conducting fluid pressure into said cavity which fluid pressure biases said cheek plate into a position blocking communication between said expanding and contracting fluid pockets, a servo valve located in said cam member for venting the pressure in said cavity to thereby control the position of the cheek plate, a second fluid passage, said second fluid passage being in said cheek plate and communicating system pressure to said servo valve so that said servo valve responds to changes in the system pressure, a third fluid passage, said third fluid passage being through said cheek plate and a portion of said cam ring and communicating said cavity with said servo valve, and said servo valve having a position blocking said third passage and movable to vent said third passage.

2. A pump as defined in claim 1 wherein said servo valve includes a chamber in said cam ring and a spool axially slidable in said chamber, and said third fluid passage communicates with said chamber in said cam member intermediate the opposite ends of said spool, 3. A pump as defined in claim 2 wherein said spool includes a circumferential groove therearound communicating the pressure in said third fluid passage circumferentially around said spool member.

4. A pump as defined in claim 2 wherein said chamber containing said spool member extends through said cam member and opens on opposite axial faces of said cam member.

5. A pump as defined in claim 3 wherein said spool has first and second opposite end faces, and said pump further includes means for communicating fluid pressure from said contracting fluid pockets to said first end face of said spool, said second passage being disposed to communicate fluid pressure from the system to said second end face of said spool, said cheek plate having a part fixedly attached thereto and projecting into said chamber, said part being movable in said chamber upon movement of said cheek plate, seal means for maintaining a fluid tight seal between said part and said chamber when said part moves in said chamber, and said second passage includes a passage portion through said part.

6. A pump as defined in claim 5, further including biasing means acting between said part and said spool for biasing said spool in the same direction as the fluid pressure acting on said first end face of said spool.

7. A pump as defined in claim 1, wherein said cam member has surface means defining an outlet conduit extending therethrough for communicating fluid from one axial side of said pump through said cam member to the opposite axial side of said pump.

8. A pump as defined in claim 7 wherein fluid from contracting pumping pockets flows from the opposite sides of said cam member, the flow from one side being through said outlet conduit in said cam member, and said cheek plate has a chamber in which said flows are combined and an outlet passage for directing flow from said chamber in which said flows are combined.

9. A pump as defined in claim 8 wherein said outlet passage is located centrally of said cheek plate and directs fluid in a direction coaxial with the axis of relative rotation of said members, said cheek plate having a tubular member fixedly connected therewith and defining at least in part said passage.

10. A pump as defined in claim 9, further including a housing member enclosing said cam member, vanes and rotor, said tubular member being received in an opening in said housing, and seal means for sealingly connecting said tubular member with said housing.

11. A pump for supplying fluid to a system, said pump comprising a rotor member, a cam member encircling said rotor member, means for effecting relative rotation of said members about an axis, a plurality of vanes carried by one of said members and engaging the other of said members and defining pumping pockets which expand and contract on relative rotation of said members, a cheek plate extending radially of said axis and disposed adjacent one axial side of said rotor member and cam member and movable along the rotational axis to communicate expanding and contracting pumping pockets, means defining a cavity on one side of said cheek plate, a fluid passage conducting fluid pressure into said cavity which fluid pressure biases said cheek plate into a position blocking the flow of fluid from said contracting pumping pockets to said expanding pumping pockets, a servo valve for venting the pressure in said cavity to thereby control the flow of fluid between said contracting and expanding pockets, a fluid passage in said cheek plate receiving flow from said contracting pockets, said fluid passage having a portion directing flow from said contracting pumping pockets radially inwardly of said cheek plate, a tubular member fixedly attached to said cheek plate coaxially with the axis of relative rotation of said members, the interior of said tubular member communicating with said portion of said fluid passage directing flow radially inwardly, a housing member defining a chamber in which said cam ring, rotor and cheek plate are located and having a discharge orifice coaxial with said tubular member, and means providing a seal between said tubular member and said housing member enabling said tubular member to move with said cheek plate relative to said housing member while maintaining said seal.

12. A pump as defined in claim 11 wherein said servo valve includes a valve chamber and a valve spool slidably received in said valve chamber, said cam having surface portions defining said valve chamber, a first passage in said cheek plate for communicating system pressure to act on a first end surface of said valve spool, a second passage for communicating pressure from said contracting pumping pockets to act on a second end surface of said valve spool in opposition to the pressure acting on said first end surface, and a third passage through said cheek plate and a portion of said cam member and communicating said cavity with said servo valve.

* * * * *